US009411259B2

(12) United States Patent
Hayashi et al.

(10) Patent No.: US 9,411,259 B2
(45) Date of Patent: Aug. 9, 2016

(54) IMAGE FORMING APPARATUS

(71) Applicant: CANON KABUSHIKI KAISHA, Tokyo (JP)

(72) Inventors: Kodai Hayashi, Suntou-gun (JP); Yoshihiro Mitsui, Numazu (JP); Naoki Fukushima, Mishima (JP); Shuhei Kawasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/641,816

(22) Filed: Mar. 9, 2015

(65) Prior Publication Data

US 2015/0261122 A1 Sep. 17, 2015

(30) Foreign Application Priority Data

Mar. 14, 2014 (JP) ..... 2014-052722

(51) Int. Cl.
*G03G 15/08* (2006.01)
*G03G 15/06* (2006.01)

(52) U.S. Cl.
CPC ..... *G03G 15/065* (2013.01); *G03G 2215/0132* (2013.01)

(58) Field of Classification Search
CPC ..... G03G 15/065; G03G 2215/0132
See application file for complete search history.

(56) References Cited

U.S. PATENT DOCUMENTS 5,826,144 A 10/1998 Takenaka et al.
7,068,966 B2 6/2006 Shinohara et al.
7,158,740 B2 1/2007 Shinohara et al.
7,912,390 B2 3/2011 Mitsui
7,957,658 B2 6/2011 Mitsui
8,155,539 B2 4/2012 Kawasaki et al.
8,548,344 B2 10/2013 Mitsui
2015/0003873 A1 1/2015 Sato et al.

FOREIGN PATENT DOCUMENTS

JP H09-015976 A 1/1997
JP 2010-160236 A 7/2010
JP 2010160236 A * 7/2010

OTHER PUBLICATIONS

Yoshihiro Mitsui et al., U.S. Appl. No. 14/641,826, filed Mar. 9, 2015.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes a developer bearing member, a developing bias application unit, a developer supply member, and a supply bias application unit that applies a supply bias to the developer supply member. In a predetermined period before a start of image formation during an image forming operation for an image formed on one recording material, the supply bias application unit applies a supply bias of which the magnitude of an absolute value is smaller than that of a developing bias, to the developer supply member. In a period between the start of image formation and an end of image formation during the image forming operation, the supply bias application unit applies a supply bias to the developer supply member so that a difference in the magnitude of the absolute value from the supply bias in the predetermined period before the start of image formation increases gradually.

16 Claims, 9 Drawing Sheets

IMAGE FORMING APPARATUS

BACKGROUND OF THE INVENTION

1. Field of the Invention

The present invention relates to an image forming apparatus.

2. Description of the Related Art

An electrophotographic apparatus or an electrostatic recording apparatus (hereinafter, an image forming apparatus) such as a copying machine, a printer, or a facsimile includes a developing assembly for visualizing an electrostatic latent image using a non-magnetic single-component toner. Conventionally, a developing assembly which includes a developing roller as a developer bearing member for bearing and conveying toner and a supply roller disposed around the developing roller and serving as a developer supply member for supplying toner to the developing roller is known. In this developing assembly, toner is supplied to the developing roller while being triboelectrically charged by mechanical rubbing between the supply roller and the developing roller. The supplied toner, of which the thickness of a toner layer on the developing roller is regulated to a predetermined amount by a developer regulating member, is conveyed to a developing zone near a photosensitive drum, which is an electrostatic latent image bearing member, and the electrostatic latent image is visualized as a toner image.

Toner which remains on the developing roller without being used for development in the developing zone (hereinafter referred to as a "development residue toner") is scraped off the developing roller by mechanical rubbing between the supply roller and the developing roller in a contact region contacting the supply roller. Simultaneously with this, toner is supplied from the supply roller to the developing roller. On the other hand, the scraped toner is mixed with toner present inside and near the supply roller.

Conventionally, depending on a printing pattern during an image formation period in such a developing assembly, a phenomenon in which a halftone density immediately after a background portion is different from a halftone density (hereinafter referred to as a "development ghost") immediately after solid print may occur. The development ghost occurs due to a difference in toner charge amount which results from a difference in printing pattern and is likely to occur when the supply roller has low scraping performance.

The development ghost can be reduced when the mechanical scraping performance of the supply roller is enhanced in order to solve this problem. In this case, however, since the mechanical rubbing between the developing roller and the supply roller increases, deterioration of toner may be accelerated. If toner deterioration (that is, separation and embedding of external additives on the surface of toner) is accelerated, the degree of agglomeration may increase and charging performance may decrease. As a result, a problem such as toner filming which is melt adhesion of toner on the surface of the developing roller may occur, which may become a hindrance to extending the service life of the developing assembly. Due to this, it is desired to suppress the occurrence of development ghost using methods other than the method of enhancing mechanical rubbing.

SUMMARY OF THE INVENTION

In this regard, a method of applying a bias to create a potential difference between a developing roller and a supply roller to supply toner from the supply roller to the developing roller and collect toner from the developing roller with the aid of electrostatic force is generally used (see Japanese Patent Application Publication No. H9-15976). Specifically, Japanese Patent Application Publication No. H9-15976, proposes a method of performing control of applying a bias for collecting toner on an intermediate roller corresponding to a developing roller during a non-image formation period and applying a bias for forming a toner layer on the intermediate roller during an image forming operation. With this control, it is sure that an increase in the toner charge amount can be suppressed during the non-image formation period. However, during the image forming operation, the toner charge amount on the developing roller may increase after a background color is formed. As a result, a difference in the toner charge amount resulting from a difference in printing pattern may occur and development ghost may occur. The increase in the toner charge amount during the image forming operation may be suppressed by controlling the bias for collecting the toner on the developing roller to the supply roller during the image forming operation. In this case, however, a sufficient amount of toner is not supplied to the developing roller during the image forming operation. As a result, when an image having a high printing ratio such as a full solid image is printed, image voids (hereinafter referred to as "solid image compliance defects") which are images that are not printed due to an insufficient amount of toner supply may occur.

An object of the present invention is to provide an image forming apparatus capable of suppressing development ghost, preventing solid image compliance defects, and extending its service life.

In order to achieve the object described above, there is provided an image forming apparatus that forms an image on a recording material, comprising:

a developer bearing member that bears a developer and develops an electrostatic latent image formed on an image bearing member to form a developer image when a developing bias is applied thereto;

a developing bias application unit that applies a developing bias to the developer bearing member;

a developer supply member that is provided so as to make contact with the developer bearing member and supplies a developer to the developer bearing member when a supply bias is applied thereto; and a supply bias application unit that applies a supply bias to the developer supply member, wherein in a predetermined period up to a start of image formation during an image forming operation for an image formed on one recording material, the supply bias application unit applies a supply bias of which the magnitude of an absolute value is smaller than that of a developing bias, to the developer supply member, and in a period between the start of image formation and an end of image formation during the image forming operation for the image formed on one recording material, the supply bias application unit applies a supply bias to the developer supply member so that a difference in the magnitude of the absolute value from the supply bias in the predetermined period up to the start of image formation increases gradually.

In order to achieve the object described above, there is provided an image forming apparatus that forms an image on a recording material, comprising:

a developer bearing member that bears a developer and develops an electrostatic latent image formed on an image bearing member to form a developer image when a developing bias is applied thereto;

a developing bias application unit that applies a developing bias to the developer bearing member;

a developer supply member that is provided so as to make contact with the developer bearing member and supplies a developer to the developer bearing member when a supply bias is applied thereto; and a supply bias application unit that applies a supply bias to the developer supply member, wherein in a predetermined period up to a start of image formation during an image forming operation for an image formed on one recording material, the supply bias application unit applies a supply bias of which the magnitude of an absolute value is smaller than that of a developing bias, to the developer supply member, and in a period between the start of image formation and an end of image formation during the image forming operation for the image formed on one recording material, the developing bias application unit applies a developing bias to the developer bearing member and the supply bias application unit applies a supply bias to the developer supply member so that a biasing force that biases a developer in a contact region between the developer bearing member and the developer supply member from the developer supply member to the developer bearing member gradually increases.

In order to achieve the object described above, there is provided an image forming apparatus that forms an image on a recording material, comprising:

a developer bearing member that develops an electrostatic latent image formed on an image bearing member to form a developer image; and a developer supply member that supplies a developer to the developer bearing member, wherein in a predetermined period up to a start of image formation during an image forming operation for an image formed on one recording material, a supply bias of which the magnitude of an absolute value is smaller than that of a developing bias applied to the developer bearing member is applied to the developer supply member, and in a period between the start of image formation and an end of image formation during the image forming operation for the image formed on one recording material, a supply bias is applied to the developer supply member so that a difference in the magnitude of the absolute value from the supply bias in the predetermined period up to the start of image formation increases gradually.

In order to achieve the object described above, there is provided a process cartridge comprising:

a developer bearing member that develops an electrostatic latent image formed on an image bearing member to form a developer image; and a developer supply member that supplies a developer to the developer bearing member, wherein in a predetermined period up to a start of image formation during an image forming operation for an image formed on one recording material, a supply bias of which the magnitude of an absolute value is smaller than that of a developing bias applied to the developer bearing member is applied to the developer supply member, and in a period between the start of image formation and an end of image formation during the image forming operation for the image formed on one recording material, a supply bias is applied to the developer supply member so that a difference in the magnitude of the absolute value from the supply bias in the predetermined period up to the start of image formation increases gradually.

According to the aspects of the present invention, it is possible to suppress development ghost which may occur when toner deterioration is suppressed and to prevent the occurrence of solid image compliance defects. Due to this, it is possible to provide a high-quality image forming apparatus capable of extending its service life.

Further features of the present invention will become apparent from the following description of exemplary embodiments with reference to the attached drawings.

DESCRIPTION OF THE EMBODIMENTS

Hereinafter, the embodiment of the present invention will be described in detail based on examples with reference to the drawings. However, dimensions, materials, shapes, relative positions, and the like of constituent components described in the embodiment are changed appropriately according to a configuration and various conditions of an apparatus to which the present invention is applied. That is, the scope of the present invention is not limited to the following embodiments.

Embodiment

Image Forming Apparatus

Figure 1:
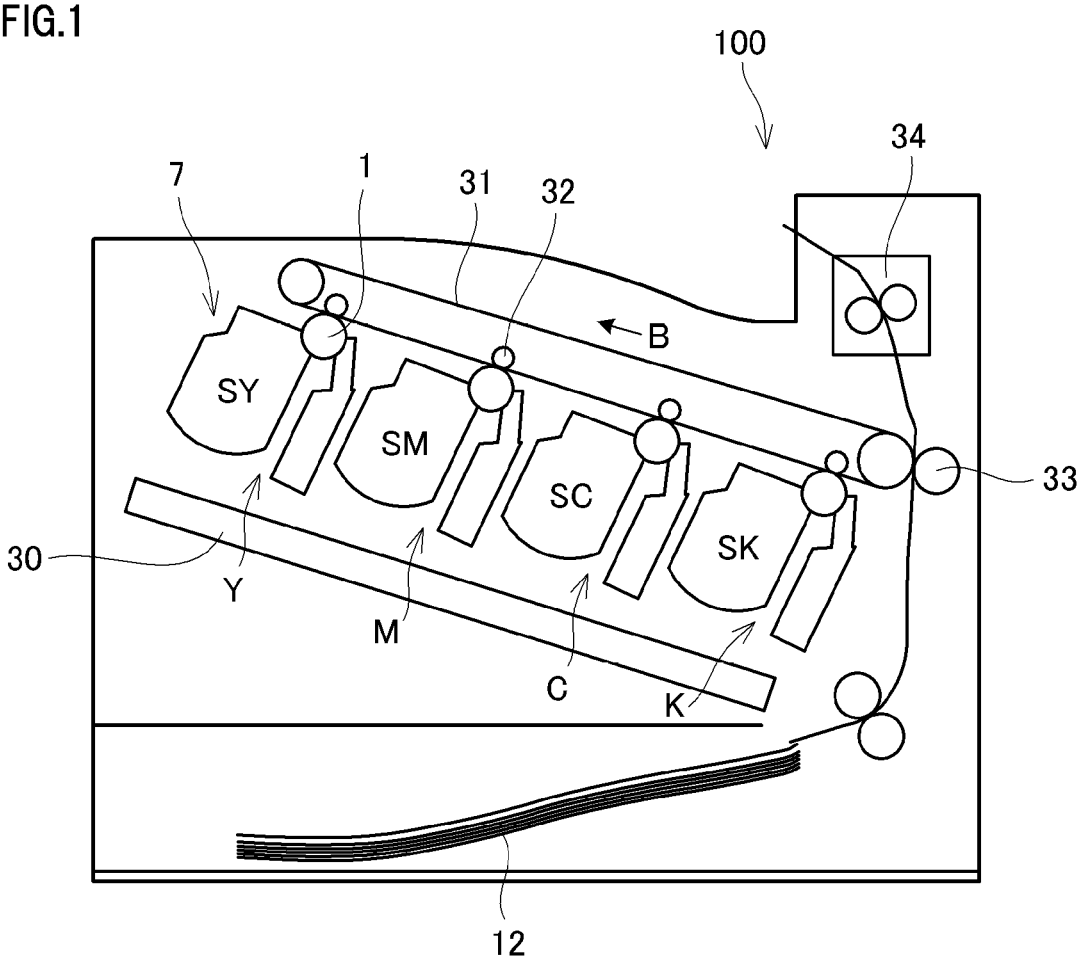
FIG. 1 is a schematic cross-sectional view of an image forming apparatus according to an embodiment of the present invention.

An overall configuration of an electrophotographic image forming apparatus (image forming apparatus) according to an embodiment of the present invention will be described with reference to FIG. 1. FIG. 1 is a schematic cross-sectional view of an image forming apparatus 100 according to the present embodiment. In the present embodiment, a case where the present invention is applied to a full-color laser beam printer which employs an in-line system and an intermediate transfer system will be described as an example of an image forming apparatus. The image forming apparatus 100 can form a full-color image on a recording material (for example, recording paper, a plastic sheet, and a cloth) according to image information. The image information is input to the main body of the image forming apparatus from an image reading apparatus which is connected to the image forming apparatus, or from a host device, such as a personal computer, which is connected in a communicable fashion with the main body of the image forming apparatus.

In the image forming apparatus 100, process cartridges 7 as a plurality of image forming units include image forming units SY, SM, SC, and SK for forming images of the respective colors yellow (Y), magenta (M), cyan (C), and black (K), respectively. In the present embodiment, the image forming units SY, SM, SC, and SK are arranged in line in a direction crossing a vertical direction. Moreover, the process cartridges 7 of the respective colors have the same shape and store toner of the respective colors yellow (Y), magenta (M), cyan (C), and black (K), respectively. A process cartridge for black which is more frequently used may have a larger size than the other process cartridges.

The process cartridge 7 is detachably attachable to an image forming apparatus body (hereinafter an apparatus body) by means of a mounting unit such as a mounting guide and a positioning member disposed in the apparatus body. Here, the apparatus body is an apparatus constituent part excluding at least the process cartridge 7 from the constituent parts of the image forming apparatus 100. The developing assembly 3 may be solely detachably attached to the apparatus body, and in this case, an apparatus constituent part excluding the developing assembly 3 from the constituent parts of the image forming apparatus 100 may be referred to as the apparatus body.

A photosensitive drum (image bearing member) 1 is driven to be rotated by a driving unit (driving source) (not illustrated). A scanner unit (exposure apparatus) 30 is disposed around the photosensitive drum 1. The scanner unit is an exposure unit that emits laser based on image formation to form an electrostatic image (electrostatic latent image) on the photosensitive drum 1. Laser exposure in a main scanning direction (a direction orthogonal to a conveying direction of the recording material 12) is started from a position signal called a BD signal from a polygon scanner in respective scan lines. On the other hand, in a sub-scanning direction (the conveying direction of the recording material 12), the laser exposure is performed with a predetermined delay from a TOP signal generated from a switch (not illustrated) disposed in a conveying path of the recording material 12. In this way, laser exposure can be performed always at the same position on the photosensitive drum 1 in the four process stations Y, M, C, and K.

An intermediate transfer belt 31 as an intermediate transfer member for transferring a toner image (developer image) on four photosensitive drums 1 to the recording material 12 is disposed so as to face the photosensitive drums. The intermediate transfer belt 31 formed of an endless belt as an intermediate transfer member circulates (rotates) in the direction indicated by arrow B (counterclockwise) while making contact with all photosensitive drums 1. Four primary transfer rollers 32 as a primary transfer unit are arranged in parallel on an inner circumference side of the intermediate transfer belt 31 so as to face the respective photosensitive drums 1. A bias having a polarity opposite to the normal charging polarity of toner is applied to the primary transfer roller 32 from a primary transfer bias power source (high-voltage power source) as a primary transfer bias application unit (not illustrated). In this way, the toner image on the photosensitive drum 1 is transferred (primarily transferred) to the intermediate transfer belt 31.

Moreover, a secondary transfer roller 33 as a secondary transfer unit is disposed on an outer circumference side of the intermediate transfer belt 31. A bias having a polarity opposite to the normal charging polarity of toner is applied to the secondary transfer roller 33 from a secondary transfer bias power source (high-voltage power source) as a secondary transfer bias application unit (not illustrated). In this way, the toner image on the intermediate transfer belt is transferred (secondarily transferred) to the recording material 12. For example, when a full-color image is formed, the above-described processes are sequentially performed in the image forming units SY, SM, SC, and SK, whereby the toner images of respective colors on the intermediate transfer belt are primarily transferred in a sequentially superimposed manner. After that, the recording material 12 is conveyed to a secondary transfer unit in synchronization with the movement of the intermediate transfer belt 31. The four-color toner images on the intermediate transfer belt 31 are collectively secondarily transferred to the recording material 12 by the action of the secondary transfer roller 33 which is in contact with the intermediate transfer belt 31 with the recording material 12 interposed.

The recording material 12 having the toner image transferred thereto is conveyed to a fixing apparatus 34 as a fixing unit. The fixing apparatus 34 applies heat and pressure to the recording material 12 whereby the toner image is fixed to the recording material 12. After that, the recording material 12 having the toner image fixed thereto is discharged to a sheet discharge tray provided on an upper surface of the apparatus body.

[Process Cartridge]

Figure 2:
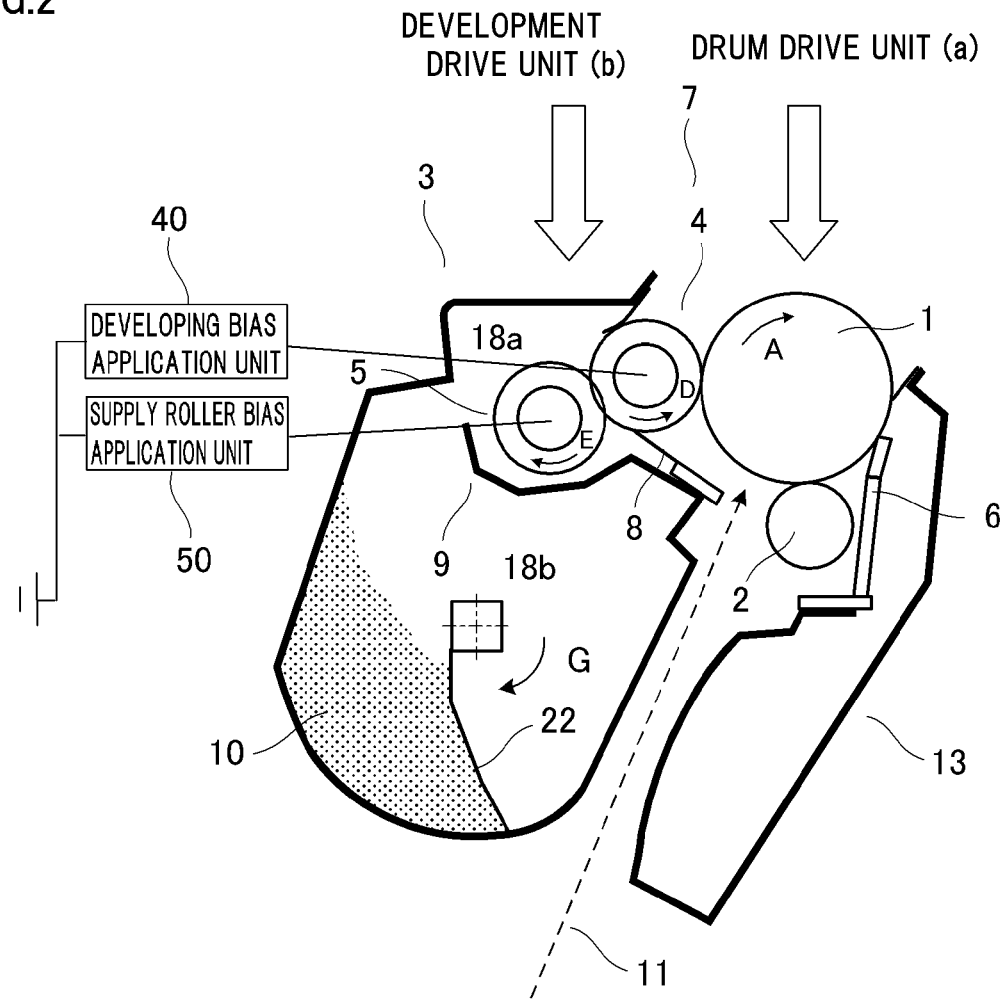
FIG. 2 is a schematic cross-sectional view of a process cartridge used in the embodiment of the present invention.

An overall configuration of the process cartridge 7 mounted on the image forming apparatus 100 according to the present embodiment will be described with reference to FIG. 2. FIG. 2 is a cross-sectional view (a main cross-sectional view) schematically illustrating a cross-section perpendicular to the direction (the direction of the rotation axis) of the photosensitive drum 1 of the process cartridge 7 according to the present embodiment. In the present embodiment, the configurations and the operations of the process cartridges 7 of the respective colors are substantially the same except the types (colors) of developer stored therein.

The process cartridge 7 includes a photosensitive unit 13 having the photosensitive drum 1 and the like and a developing unit 3 having the developing roller 4 and the like. The photosensitive drum 1 is rotatably attached to the photosensitive unit 13 with a bearing (not illustrated) interposed. The photosensitive drum 1 is driven to be rotated in the direction indicated by arrow A according to an image forming operation by receiving a driving force of a driving motor as a photosensitive drum drive unit (a). Moreover, a charging roller 2 and a cleaning member 6 are disposed in the photosensitive unit 13 so as to make contact with the circumferential surface of the photosensitive drum 1. A bias sufficient for loading a desired charge on the photosensitive drum 1 is applied to the charging roller 2 from a charging bias power source (high-voltage power source) as a charging bias application unit (not illustrated). In the present embodiment, the application bias is set such that a potential (charging potential: Vd) on the photosensitive drum 1 is −500 V. The photosensitive drum 1 charged by the charging roller 2 is irradiated with a laser beam 11 from the scanner unit 30 based on the image information, whereby an electrostatic image (electrostatic latent image) is formed on the photosensitive drum 1.

On the other hand, the developing unit 3 includes a developing chamber **18*a* and a developer accommodating chamber 18*b*. The developer accommodating chamber 18*b* is disposed under the developing chamber 18*a*. Toner 10 as a developer is stored in the developer accommodating chamber 18*b*. Moreover, a developer conveying member 22 for conveying the toner 10 to the developing chamber 18*a* is provided in the developer accommodating chamber 18*b*. The developer conveying member 22 rotates in the direction indicated by arrow G to thereby convey the toner to the developing chamber 18*a*. In the present embodiment, a toner having a negative normal charging polarity is used as the toner 10**, and in the following description, it is assumed that a negative-charging toner is used. However, the toner that can be used in the present invention is not limited to a negative-charging toner, and a positive-charging toner having a positive normal charging polarity may be used depending on an apparatus configuration.

A developing roller 4 as a developer bearing member that makes contact with the photosensitive drum 1 and rotates in the direction indicated by arrow D by receiving the driving force from a driving motor as a development drive unit (b) is provided in the developing chamber 18*a*. In the present embodiment, the developing roller 4 and the photosensitive drum 1 rotate so that the respective surfaces move in the same direction at the facing portions (contacting portions). Moreover, a bias sufficient for developing and visualizing the electrostatic latent image on the photosensitive drum 1 as a toner image is applied to the developing roller 4 from a developing roller bias power source (high-voltage power source) 40 as a developing roller bias application unit (developing bias application unit).

Further, a toner supply roller (hereinafter a supply roller) 5 and a toner amount regulating member (hereinafter a regulating member) 8 are disposed in the developing chamber 18*a*. The supply roller (developer supply member) 5 is a roller for supplying the toner conveyed from the developer accommodating chamber 18*b* to the developing roller 4, and the regulating member 8 regulates the amount of toner coated on the developing roller 4 supplied by the supply roller 5 and applies electric charges to the toner. A bias is applied to the supply roller 5 from a supply roller bias power source (high-voltage power source) 50 as a supply roller bias application unit (supply bias application unit).

The supply roller 5 is an elastic sponge roller having a foam layer formed on an outer circumference of a conductive core and is arranged in a portion facing the developing roller 4 so as to form a predetermined contact portion on the circumferential surface of the developing roller 4. The supply roller 5 rotates in the direction indicated by arrow E by receiving the driving force of the driving motor as the development drive unit (b). In the present embodiment, the developing roller 4 rotates at a speed of 100 rpm and the supply roller 5 rotates at a speed of 200 rpm. Moreover, the supply roller 5 used in the present embodiment has a resistance of 4×10ˆ6Ω and rigidity of 190 gf. The rigidity of the supply roller 5 in the present embodiment is a value of a load measured when a flat plate having a width of 50 mm in the longitudinal direction is penetrated into the supply roller 5 by 1 mm from the surface thereof.

The toner supplied to the developing roller 4 by the supply roller 5 enters a contact region between the regulating member 8 and the developing roller 4 with rotation of the developing roller 4 in the direction indicated by arrow D. The toner born on the developing roller 4 is triboelectrically charged by the rubbing between the surface of the developing roller 4 and the regulating member 8 whereby electric charges are applied thereto and the thickness of the toner layer is regulated. The regulated toner on the developing roller 4 is conveyed to a portion facing the photosensitive drum 1 with rotation of the developing roller 4, whereby the electrostatic latent image on the photosensitive drum 1 is developed and visualized as a toner image. The supply roller 5 and the developing roller 4 may rotate in the same direction (that is, relative moving directions (rotation directions) in the contact region may be opposite to each other).

The toner that remains in the developing zone on the developing roller 4 without being used for development (development residue toner) enters a contact region contacting the supply roller 5 with rotation in the direction indicated by arrow D of the developing roller 4. A portion of the development residue toner is collected by the supply roller 5 due to mechanical rubbing between the developing roller 4 and the supply roller 5 and potential difference between the developing roller 4 and the supply roller 5 and is mixed with the toner inside and near the supply roller 5. On the other hand, the toner, of the development residue toner, that remains on the developing roller 4 without being collected by the supply roller 5 is applied with electric charges by rubbing with the supply roller 5 and is mixed with toner newly supplied from the supply roller 5.

[Biasing Force Acting on Toner]

Figure 9:
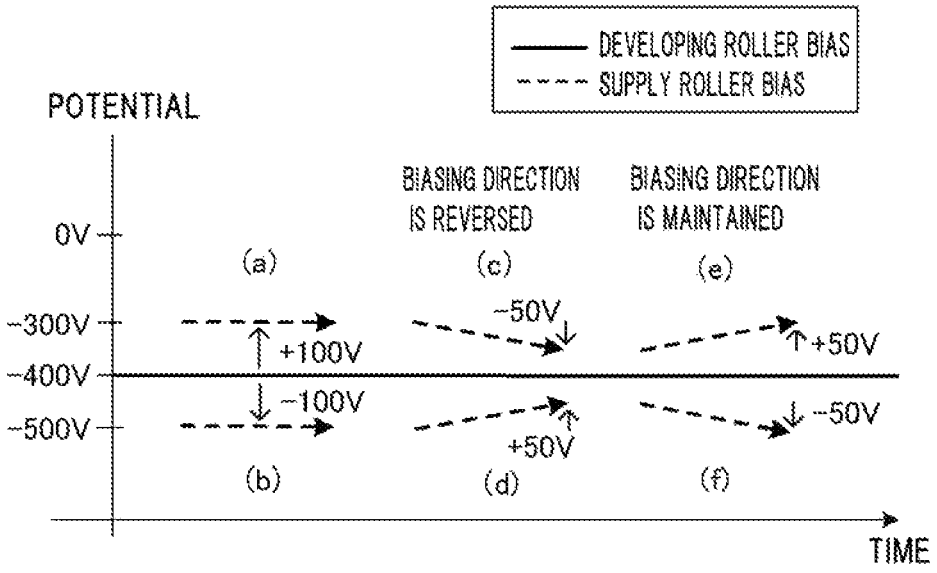
FIG. 9 is a schematic diagram illustrating a relation between a potential difference in bias and a toner biasing force.

Here, force that biases toner to either the supply roller 5 or the developing roller 4 acts on the toner in the contact region between the supply roller 5 and the developing roller 4 depending on a magnitude relation between the bias applied to the supply roller 5 and the bias applied to the developing roller 4. Referring to FIG. 9, the biasing force acting on the toner in the contact region between the supply roller 5 and the developing roller 4 will be described. FIG. 9 illustrates various patterns (a) to (f) of a supply roller bias and a developing roller bias which change with time, in which the vertical axis represents potential and the horizontal axis represents time.

[[When Bias Potential Difference is Constant]]

The direction in which the biasing force acting on toner acts on the supply roller 5 or the developing roller 4 is determined by the polarity of a value obtained by subtracting the value of the bias applied to the developing roller 4 from the value of the bias applied to the supply roller 5. That is, the toner biasing direction is determined by the polarity of the difference of the potential of the supply roller bias from the potential of the developing roller bias. When the polarity of the bias potential difference is the same as the normal charging polarity of the toner, force that biases toner from the supply roller 5 to the developing roller 4 acts on the toner in the contact region (Pattern (b)). In contrast, when the polarity of the bias potential difference is opposite to the normal charging polarity of the toner, force that biases toner from the developing roller 4 to the supply roller 5 acts on the toner in the contact region (Pattern (a)).

Specifically, as in Pattern (a) of FIG. 9, when the developing roller bias is −400 V and the supply roller bias is −300 V, the bias potential difference is (−300 V)−(−400 V)=+100 V and has a positive polarity. When the normal charging polarity of toner is negative, since the polarity of the bias potential difference is opposite to the normal charging polarity of toner, force that biases toner from the developing roller 4 to the supply roller 5 acts on the toner.

On the other hand, as in Pattern (b) of FIG. 9, when the developing roller bias is −400 V and the supply roller bias is −500 V, the bias potential difference is (−500 V)−(−400 V)=−100 V and has a negative polarity. When the normal charging polarity of toner is negative, since the polarity of the bias potential difference is the same as the normal charging polarity of toner, force that biases toner from the supply roller 5 to the developing roller 4 acts on the toner.

Moreover, the larger the bias potential difference between the supply roller 5 and the developing roller 4, the larger the magnitude of the biasing force acting on the toner. Both the force that biases toner to the supply roller 5 and the force that biases toner to the developing roller 4 act on the toner in the contact region, and the bias potential difference indicates the difference in the magnitude of both forces. That is, among the forces acting on the toner, a more dominant one of the force that biases toner to the supply roller 5 and the force that biases toner to the developing roller 4 is determined by the polarity and the magnitude of the potential difference between the supply roller 5 and the developing roller 4. Thus, when the potential difference is zero, the two biasing forces compete each other, and as a result, the biasing force acting on the toner becomes zero.

[[When Bias Potential Difference Changes]]

The above-described phenomenon occurs when the values of applied biases are constant (that is, when the bias potential difference is constant). On the other hand, when the value of the bias changes, and thus, the bias potential difference changes (during a period where the bias potential difference is changing), the direction of biasing force acting on toner changes depending on the way in which the bias potential difference changes.

For example, when the bias potential difference is gradually changed to such a magnitude that the force that biases toner from the supply roller 5 to the developing roller strengthens, the force that holds the toner inside the supply roller 5 weakens whereas the force that supplies the toner inside the supply roller 5 to the developing roller 4 strengthens. With this, of the toner present inside and on the surface of the supply roller 5, toner which is highly sensitive to a potential difference starts being gradually supplied to the developing roller 4. That is, when the bias potential difference changes in such a way that the magnitude of biasing force of which the direction is determined by its polarity decreases, biasing force in the direction opposite to the direction determined by the polarity becomes dominant regardless of the polarity and the magnitude of the bias potential difference at that time-point. As a result, the direction of the biasing force acting on toner is reversed (Patterns (c) and (d)).

As in Pattern (c) of FIG. 9, when the developing roller bias is constant at −400 V whereas the supply roller bias changes from −300 V to −350 V in a predetermined period, the bias potential difference changes from +100 V to +50 V. That is, the bias potential difference (the magnitude of supply bias) is changed by −50 V with the elapse of time and the polarity of a change (inclination) per unit time is negative. When the normal charging polarity of toner is negative, this change occurs in such a way that the magnitude of the biasing force that biases toner from the developing roller 4 to the supply roller 5 due to the positive polarity opposite to the polarity of toner decreases gradually. Thus, as the force acting on the toner during the period where the bias potential difference is changing, the biasing force that biases toner in the direction opposite to the direction determined by the positive polarity (the direction from the supply roller 5 to the developing roller 4 due to the negative polarity) is dominant. As a result, biasing force in the direction corresponding to the negative polarity acts on the toner regardless of the fact that the bias potential difference has a positive polarity.

Similarly, as in Pattern (d) of FIG. 9, when the developing roller bias is constant at −400 V whereas the supply roller bias changes from −500 V to −450 V in a predetermined period, the bias potential difference changes from −100 V to −50 V. That is, the bias potential difference (the magnitude of supply bias) is changed by +50 V with the elapse of time and the polarity of a change (inclination) per unit time is positive. When the normal charging polarity of toner is negative, this change occurs in such a way that the magnitude of the biasing force that biases toner from the supply roller 5 to the developing roller 4 due to the same negative polarity as the polarity of toner decreases gradually. Thus, as the force acting on the toner during the period where the bias potential difference is changing, the biasing force that biases toner in the direction opposite to the direction determined by the positive polarity (the direction from the developing roller 4 to the supply roller 5 due to the positive polarity) is dominant. As a result, biasing force in the direction corresponding to the positive polarity acts on the toner regardless of the fact that the bias potential difference has a negative polarity.

On the other hand, when the bias potential difference changes in such a way that the magnitude of biasing force of which the direction is determined by its polarity increases, the biasing force becomes more dominant, and the direction of the biasing force acting on toner does not change but is maintained (Patterns (e) and (f)).

As in Pattern (e) of FIG. 9, when the developing roller bias is constant at −400 V whereas the supply roller bias changes from −350 V to −300 V in a predetermined period, the bias potential difference changes from +50 V to +100 V. That is, the bias potential difference (the magnitude of supply bias) is changed by +50 V with the elapse of time and the polarity of a change (inclination) per unit time is positive. When the normal charging polarity of toner is negative, this change occurs in such a way that the magnitude of the biasing force that biases toner from the developing roller 4 to the supply roller 5 due to the positive polarity opposite to the polarity of toner increases gradually. Thus, the force acting on the toner during the period where the bias potential difference is changing maintains the toner biasing direction determined by the positive polarity, and this biasing force becomes more dominant.

Similarly, as in Pattern (f) of FIG. 9, when the developing roller bias is constant at −400 V whereas the supply roller bias changes from −450 V to −500 V in a predetermined period, the bias potential difference changes from −50 V to −100 V. That is, the bias potential difference (the magnitude of supply bias) is changed by −50 V with the elapse of time and the polarity of a change (inclination) per unit time is negative. When the normal charging polarity of toner is negative, this change occurs in such a way that the magnitude of the biasing force that biases toner from the supply roller 5 to the developing roller 4 due to the same negative polarity as the polarity of toner increases gradually. Thus, the force acting on the toner during the period where the bias potential difference is changing maintains the toner biasing direction determined by the negative polarity, and this biasing force becomes more dominant.

[Development Ghost Occurrence Mechanism]

The mechanism of occurrence of development ghost and the relation between development ghost and the amount of development residue toner collected by the supply roller 5 will be described. Development ghost in the present embodiment refers to a phenomenon in which a halftone density immediately after solid print (hereinafter referred to as "after black print") becomes thicker than a halftone density immediately after a background portion (hereinafter referred to as "after white print"). The development ghost occurs due to such a reason that the amount of toner developed in relation to the electrostatic latent image on the photosensitive drum 1 changes due to a difference in the toner charge amount after white print and the toner charge amount after black print.

When printing is performed after black print, since toner on the developing roller 4 is consumed every time, the triboelectric charging performance of the regulating member 8 has large contribution to the charge amount of toner having passed through the regulating member 8. On the other hand, when printing is performed after white print, the triboelectric charging between the supply roller 5 and the developing roller 4 and the triboelectric charging of the regulating member 8 are applied to the development residue toner which has been changed in advance. Due to this, the toner charge amount after white print is likely to be larger than the toner charge amount after black print. This is because the development residue toner remains without being collected by the supply roller 5, and if the amount of development residue toner collected by the supply roller 5 can be increased as much as possible, the toner charge amount after white print can be controlled so as to approach the toner charge amount after black print. In this way, it is possible to decrease the difference between the toner charge amount after black print and the toner charge amount after white print and to reduce development ghost.

In order to increase the amount of development residue toner collected by the supply roller 5, it may be ideal to set the potential difference between the developing roller 4 and the supply roller 5 to such a direction that toner is biased to the supply roller 5 to thereby increase the amount of development residue toner collected by the supply roller 5. However, when the potential difference between the developing roller 4 and the supply roller 5 is just set to such a direction that toner is biased to the supply roller 5 during the image forming operation, the amount of toner supplied from the supply roller 5 to the developing roller 4 may become insufficient. As a result, when an image having a high printing ratio such as a solid image is printed, solid image compliance defects may occur.

With the foregoing in view, a method of reducing the occurrence of development ghost by increasing the amount of development residue toner collected by the supply roller 5 while preventing solid image compliance defects is required. In the present embodiment, this can be accomplished by controlling the potential difference between the developing roller 4 and the supply roller 5. Hereinafter, the details of this control and the advantages thereof will be described by way of examples.

Example 1

Control of Supply Roller Bias

Figure 3:
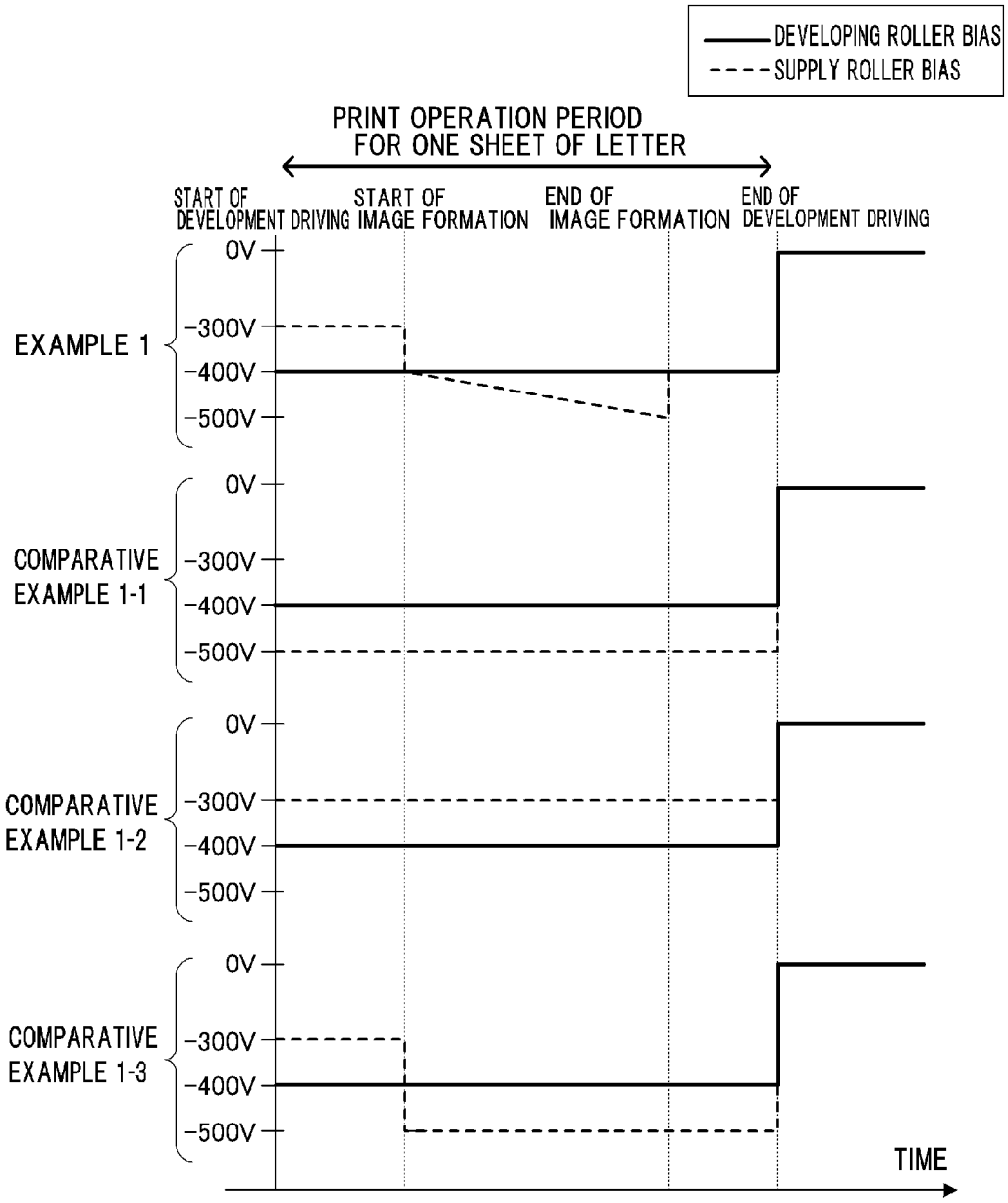
FIG. 3 is a timing chart of voltage control in Example 1 of the present invention.

Control of bias between the developing roller 4 and the supply roller 5 according to Example 1 of the present invention will be described with reference to FIG. 3. FIG. 3 is a timing chart illustrating the bias control when one sheet is printed, for comparison between Example 1 and Comparative Examples.

Here, respective time-points in the timing chart will be described in detail. The following time-points are the time-points during printing (image forming operation) of one sheet of recording material.

The time-point "start of development driving" is a time-point at which the developing roller 4 and the supply roller 5 receive the driving force of the driving motor as the development drive unit (b) and start rotating.

The time-point "start of image formation" is a time-point at which laser exposure in the sub-scanning direction starts.

The time-point "end of image formation" is a time-point at which the laser exposure in the sub-scanning direction ends.

The time-point "stopping of development driving" is a time-point at which the driving motor as the development drive unit (b) stops and the rotation of the developing roller 4 and the supply roller 5 stops.

However, the respective time-points are not limited to those described above as long as the time-points occur within the printing (image forming operation) of one sheet of recording material. For example, the time-point "start of image formation" may be set to occur a predetermined period earlier than the time-point at which the laser exposure in the sub-scanning direction starts. Moreover, the time-point "end of image formation" may be set to occur a predetermined period later than the time-point at which the laser exposure ends, for example. The respective time-points may be changed so as to be optimized depending on the configuration of the developing assembly and the image forming apparatus.

The bias applied to the developing roller 4 is constant during a period from "start of development driving" to "end of development driving," and in the present example, −400 V is applied. The developing bias is not necessarily controlled to be constant.

During a period from "start of development driving" to "start of image formation" (hereinafter referred to a "pre-rotation period"), a bias is applied to the supply roller 5 in such a direction that toner is biased from the developing roller 4 to the supply roller 5. In this way, it is possible to suppress unnecessary toner from being supplied to the developing roller 4 and to increase the amount of toner collected by the supply roller 5. Thus, it is possible to suppress an increase in the charge amount of the toner on the developing roller 4 during the pre-rotation period.

Moreover, during a period from "start of image formation" to "end of image formation," control is performed such that the bias applied to the supply roller 5 has an inclination and the potential difference increases gradually in such a direction that toner is biased from the supply roller 5 to the developing roller 4. As a result, toner which is higher sensitive to the potential difference between the developing roller 4 and the supply roller 5 starts being gradually supplied from the supply roller 5 to the developing roller 4. Thus, it is possible to suppress an amount of toner larger than necessary from being supplied from the supply roller 5 to the developing roller 4 in a leading edge of an image. As a result, it is possible to suppress an increase in the toner charge amount after white print during the image formation period and to decrease the difference between the toner charge amount after white print and the toner charge amount after black print.

Moreover, since a sufficiently large potential difference is provided between the developing roller 4 and the supply roller 5 in the latter half of the image, a sufficient amount of toner is supplied to the developing roller 4. As a result, even when an image having a high printing ratio such as a full solid image, for example, is printed, it is possible to provide a high-quality image without causing solid image compliance defects resulting from insufficient toner supply.

In the present example, −300 V is applied to the supply roller 5 during the pre-rotation period. Moreover, a bias of −400 V is applied at the time-point "start of image formation," a bias of −500 V is applied at the time-point "end of image formation," and a change per unit time in the bias applied to the supply roller 5 during the image formation period is constant. The change per unit time in the bias applied to the supply roller 5 will be referred to as a "supply roller bias inclination".

[Experiment]

Here, an experiment performed to illustrate the advantages of the present example will be described. In this experiment, an evaluation image was printed under an environment of a room temperature (23° C.) and a room humidity (60%) and development ghost and solid image compliance defects were evaluated.

Development ghost was evaluated using an evaluation image in which solid-black patches having the size of 5 mm by 5 mm were arranged at an interval of 10 mm at the leading edge of a sheet, and then, a halftone image was printed. A halftone image density after solid-black patches and a halftone image density in the other portions were measured using an X-Rite's 500-Series spectrodensitometer and this image was ranked based on a density difference according to the following criteria.

A: Density difference in halftone image is less than 0.04

B: Density difference in halftone image is 0.04 or more and less than 0.08

C: Density difference in halftone image is 0.08 or more

Solid image compliance defects were evaluated using an evaluation image in which a solid-black image was printed continuously on three sheets. The image was evaluated using an X-Rite's 500-Series spectrodensitometer as below based on a density difference between a leading edge of a third sheet of the printed solid-black image and a trailing edge thereof. In this case, the test print and the evaluation image were printed in a single color.

A: Density difference between leading sheet edge and trailing sheet edge in full solid image is less than 0.2

B: Density difference between leading sheet edge and trailing sheet edge in full solid image is 0.2 or more and less than 0.3

C: Density difference between leading sheet edge and trailing sheet edge in full solid image is 0.3 or more As examples for comparing with the advantages of the present example, the same experiment was performed when the bias was controlled according to Comparative Examples 1-1, 1-2, and 1-3 illustrated in FIG. 3, and development ghost and solid image compliance defects were evaluated. In Comparative Examples 1-1 and 1-2, a constant bias was applied during a period from "start of development driving" to "stopping of development driving," and the experiment was performed by applying −500 V for Comparative Example 1-1 and −300 V for Comparative Example 1-2. Moreover, in Comparative Example 1-3, similarly to Example 1, a bias was applied during the pre-rotation period such that toner is biased from the developing roller 4 to the supply roller 5, and a constant bias of −500 V was applied during the period from "start of image formation" to "end of image formation". The experiment results as illustrated in Table 1.

TABLE 1

| | Development Ghost | Solid Image compliance Defects |
|---|---|---|
| Example 1 | A | A |
| Comparative Example 1-1 | C | A |
| Comparative Example 1-2 | A | C |
| Comparative Example 1-3 | B | A |

When control was performed according to Comparative Example 1-1, since an amount of toner larger than necessary was supplied to the developing roller 4 during the pre-rotation period and the image formation period, the amount of toner collected by the supply roller 5 was not sufficient. As a result, the toner charge amount after white print increased, the difference between the toner charge amount after black print and the toner charge amount after white print increased, and development ghost occurred.

When control was performed according to Comparative Example 1-2, an amount of toner larger than necessary was not supplied to the developing roller 4 during the pre-rotation period and the image formation period and a sufficient amount of toner was collected by the supply roller 5. Thus, it was possible to reduce the occurrence of development ghost. However, the amount of toner supplied from the supply roller 5 to the developing roller 4 during the image formation period was not sufficient, and solid image compliance defects occurred in the full solid image.

When control was performed according to Comparative Example 1-3, it was possible to suppress an increase in the toner charge amount on the developing roller 4 during the pre-rotation period. However, since an excessively large amount of toner was supplied from the supply roller 5 to the developing roller 4 after the time-point "start of image formation," the toner charge amount after white print increased. Due to this, the toner charge amount after white print became different from the toner charge amount after black print, and slight development ghost occurred.

On the other hand, when control was performed according to the present example, such advantages as described above was obtained, and it was possible to reduce the occurrence of development ghost without causing solid image compliance defects.

In the present example, although a case of controlling the potential difference such that force that biases toner from the developing roller 4 to the supply roller 5 acts on the toner during the pre-rotation period has been described, the same control may be performed in an inter-sheet period when two or more sheets were printed continuously. The advantages of the present example are also obtained in the second or subsequent sheets of images when this control is performed during the inter-sheet period. However, the potential difference between the developing roller 4 and the supply roller 5 during the pre-rotation period may be set to be different from the potential difference between the developing roller 4 and the supply roller 5 during the inter-sheet period.

Moreover, in the present example, although the potential difference between the developing roller 4 and the supply roller 5 during the image formation period was set to the same potential side so that force that biases toner from the supply roller 5 to the developing roller 4 acts on the toner, the present invention is not limited to this. For example, the potential difference may be set such that force that biases toner from the developing roller 4 to the supply roller 5 acts on the toner during the period from "start of image formation" to "end of image formation". The respective configurations may be optimized unless solid image compliance defects occur in an image having a high printing ratio.

Example 2

An image forming apparatus according to Example 2 of the present invention performs control of changing an inclination of a change in a supply roller bias at a predetermined time-point during the image formation period. The advantages of this control appear remarkable when an image which is likely to cause development ghost is printed in the latter half of a sheet. With the control of the present example, it is possible to diminish the occurrence of development ghost even when such an image is printed. In the description of Example 2, description of the portions overlapping those of Example 1 will not be provided.

Figure 4:
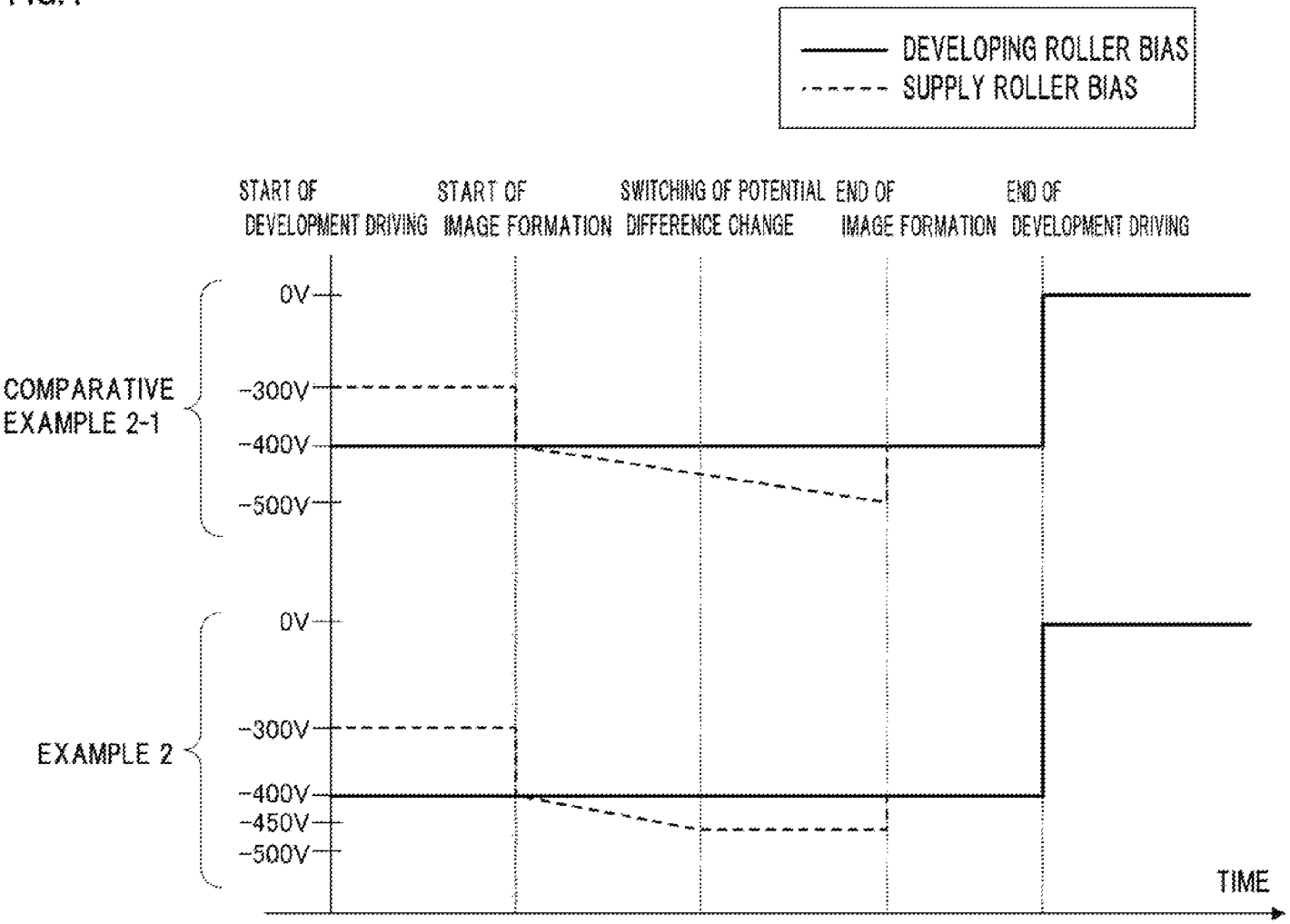
FIG. 4 is a timing chart of voltage control in Example 2 of the present invention.

The control according to Example 2 will be described with reference to a timing chart of FIG. 4. FIG. 4 is a timing chart illustrating bias control when one sheet is printed, for comparison between Comparative Example 2-1 (Example 1) and Example 2. As illustrated in FIG. 4, a time-point "switching of potential difference change" is provided at a predetermined time-point between "start of image formation" and "end of image formation". In Example 2, a supply roller bias inclination is changed in the period between "start of image formation" and "switching of potential difference change" and the period between "switching of potential difference change" and "end of image formation". Specifically, a supply roller bias inclination between "switching of potential difference change" and "end of image formation" is set to be smaller than a supply roller bias inclination between "start of image formation" and "switching of potential difference change". With this control, it is possible to suppress the amount of supplied toner in the latter half of an image and to diminish the occurrence of development ghost even when a state where toner is likely to be supplied is created.

In the present example, the time-point "switching of potential difference change" was provided after 0.6 sec from the time-point "start of image formation". Moreover, a bias of −400 V was applied to the supply roller 5 at the time-point "start of image formation" and a bias of −450 V was applied to the supply roller 5 at the time-point "switching of potential difference change". Further, a constant bias of −450 V was provided to the supply roller 5 in the period between the time-point "switching of potential difference change" and the time-point "end of image formation".

[Experiment]

An experiment performed to illustrate the advantages of the present example will be described. In this experiment, an evaluation image was printed under an environment of a room temperature (23° C.) and a room humidity (60%) and development ghost and solid image compliance defects were evaluated. In the present example, development ghost was evaluated using the image for determining development ghost, the image for determining development ghost in the latter half of a sheet, and the full solid image used in Example 1. Using these images, development ghost in the front half of a sheet, development ghost in the latter half of a sheet, and solid image compliance defects were evaluated. The image for determining development ghost in the latter half of a sheet was prepared by arranging solid-black patches having the size of 5 mm by 5 mm at an interval of 10 mm at the position of 150 mm from the leading edge of the sheet and then printing a halftone image. The experiment results are illustrated in Table 2.

TABLE 2

| | Development Ghost in Front Half of Sheet | Development Ghost in Latter Half of Sheet | Solid Image compliance Defects |
|---|---|---|---|
| Comparative Example 2-1 | A | C | A |
| Example 2 | A | B | A |

When control was performed according to Comparative Example 2-1, although it was possible to suppress the occurrence of development ghost in the front half of the sheet, it was not possible to suppress the occurrence of development ghost in the latter half of the sheet sufficiently. This was because an amount of toner larger than necessary was supplied to the developing roller 4 up to the latter half of the sheet, and the amount of development residue toner collected by the supply roller 5 was not sufficient. As a result, the toner charge amount increased, and the difference between the toner charge amount after white print and the toner charge amount after black print increased.

On the other hand, when control was performed according to Example 2 in which the change (inclination) per unit time of the magnitude of the supply bias was changed at least once, the increase in the toner charge amount on the developing roller 4 was suppressed up to the latter half of the sheet. As a result, it was possible to decrease the level of development ghost occurring in the latter half of the sheet.

In the present example, although the time-point "switching of potential difference change" was provided during the image formation period and control of changing the inclination of the change in the supply roller bias at this time-point was performed, a method of changing the inclination, the number of times thereof, and the like are not limited to this. For example, without being limited to this, control of continuously (gradually) changing the inclination of the change in the supply roller bias may be performed in the period between the time-point "start of image formation" and the time-point "end of image formation". Moreover, a plurality of time-points "switching of potential difference change" may be set, and the supply roller bias inclination may be changed a plurality of number of times.

Example 3

An image forming apparatus according to Example 3 of the present invention performs control of setting the bias value applied to the supply roller 5 during the image formation of the second and subsequent sheets to be lower than the bias value applied to the supply roller 5 during the image formation of the first sheet when two or more sheets are continuously printed. With the control of the present example, even when an inter-sheet period (conveying interval of recording materials) during continuous printing of two or more sheets is shortened, it is possible to diminish the occurrence of development ghost in the images on the second and subsequent sheets. In the description of Example 3, description of the portions overlapping those of the above-described examples will not be provided.

Figure 5:
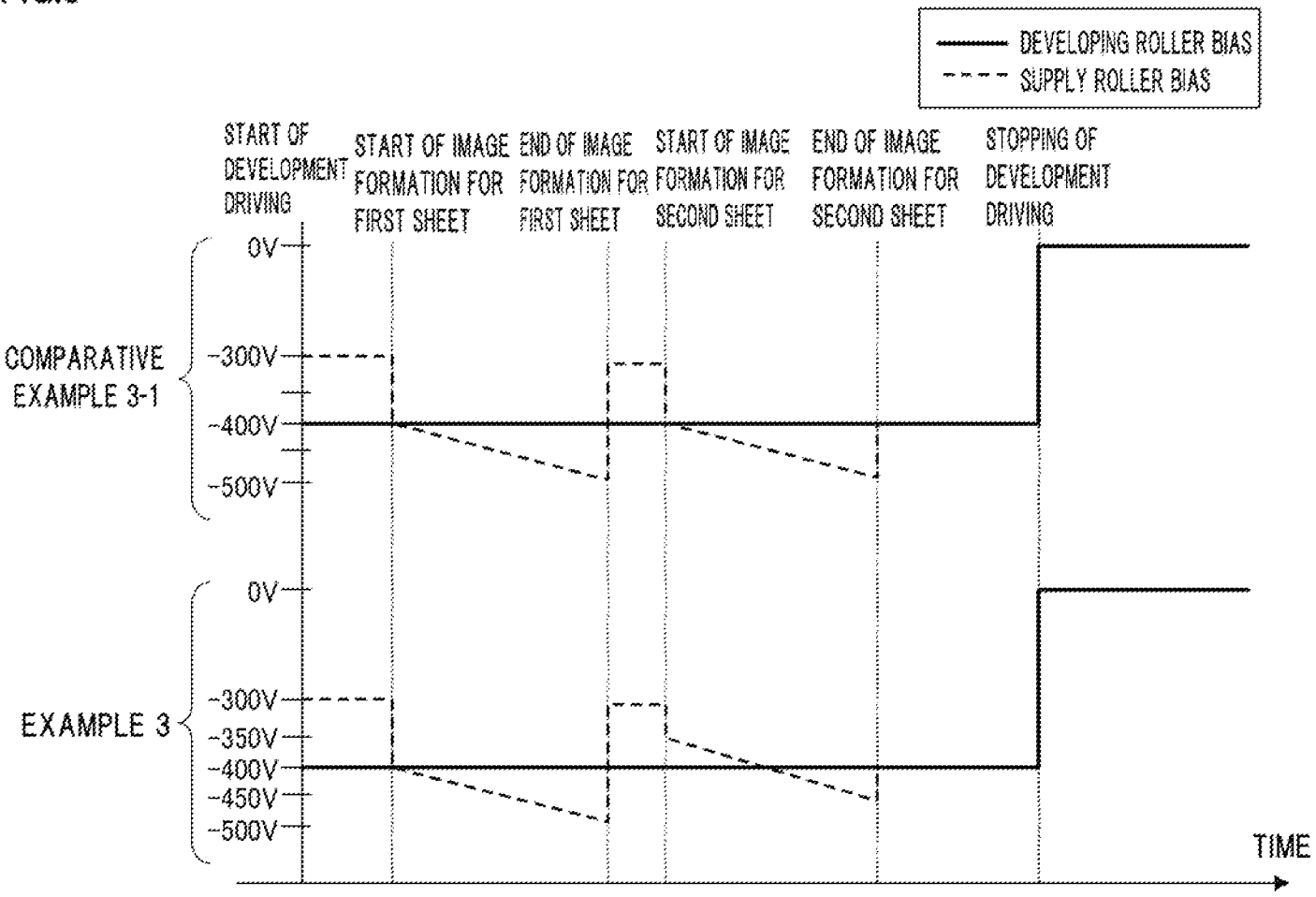
FIG. 5 is a timing chart of voltage control in Example 3 of the present invention.

The control according to Example 3 will be described with reference to the timing chart of FIG. 5. FIG. 5 is a timing chart illustrating bias control when two sheets are continuously printed, for comparison between Comparative Example 3-1 (Example 1) and Example 3. The control of the supply roller bias during the pre-rotation period is the same as that described in Example 1, and description thereof will not be provided. As illustrated in FIG. 5, such a potential difference that a force that biases toner from the developing roller 4 to the supply roller 5 acts on the toner is provided in the inter-sheet period between the first sheet and the second sheet. Subsequently, control of setting the bias applied to the supply roller 5 at the time-point "start of image formation" for the second sheet to such a value that the bias has a polarity opposite to the normal charging polarity of toner as compared to the bias applied to the supply roller for the first sheet is performed. With this control, even when it is difficult to replace the toner on the developing roller 4 sufficiently in an inter-sheet period because the inter-sheet period is short, for example, it is possible to diminish the occurrence of development ghost in the second and subsequent sheets of images Moreover, by decreasing the inter-sheet period, it is possible to shorten the output intervals of recording materials 12 from the image forming apparatus and to improve productivity. In this case, since the charge amount of toner on the developing roller 4 is suppressed to be low for the first sheet of image, it is possible to supply a sufficient amount of toner from the supply roller 5 to the developing roller 4 while diminishing development ghost.

On the other hand, in the second and subsequent sheets of images, when the inter-sheet period is short, the amount of replaced toner on the developing roller 4 in the inter-sheet period may decrease. Thus, when regions having a low printing ratio appear continuously, the charge amount of toner on the developing roller 4 may increase and development ghost may occur. In this respect, in order to diminish development ghost in the second and subsequent sheets of images, it is necessary to increase the amount of toner on the developing roller 4 collected by the supply roller 5 after the time-point "start of image formation". The control of the present example accomplishes this. With the control of the present example, it is possible to accelerate replacement of toner on the developing roller 4 after the time-point "start of image formation" and to diminish development ghost in the second and subsequent sheets of images.

[Experiment]

In the present example, the same experiment as that of Examples 1 and 2 was performed. However, in the experiment of the present example, both the image for determining development ghost and the full solid image were printed continuously on three sheets, and development ghost and solid image compliance defects were evaluated for respective images. In the present example, the pre-rotation period was set to 1 sec and the inter-sheet period was set to 0.2 sec. Moreover, a bias of −300 V was applied to the supply roller in the inter-sheet period, a bias of −350 V was applied to the supply roller at the start of image formation for the second and subsequent sheets, and a bias of −450 V was applied to the supply roller at the end of image formation for the second and subsequent sheets. The experiment results are illustrated in Table 3.

TABLE 3

| | Development Ghost | | | Solid Image compliance Defects | | |
|---|---|---|---|---|---|---|
| | First Sheet | Second Sheet | Third Sheet | First Sheet | Second Sheet | Third Sheet |
| Comparative Example 3-1 | A | B | B | A | A | A |
| Example 3 | A | A | A | A | A | A |

As illustrated in Table 3, when control was performed according to Comparative Example 3-1, slight development ghost appeared in the second and subsequent sheets of images. This was because the toner on the developing roller 4 was not collected sufficiently by the supply roller 5 in the inter-sheet period, which is likely to occur when the inter-sheet period is shorter than the pre-rotation period.

In contrast, when the control was performed according to the present example, it was possible to suppress an increase in the toner charge amount after white print during the image formation period. Due to this, it was possible to prevent the occurrence of development ghost in the second and subsequent sheets of images.

Example 4

An image forming apparatus according to Example 4 of the present invention performs control of switching "first potential" and "second potential" having different magnitudes at predetermined time-points during the pre-rotation period and the inter-sheet period. Here, the "first potential" is a potential set such that a force that biases toner from the developing roller 4 to the supply roller 5 acts on the toner during the pre-rotation period and the inter-sheet period. Moreover, the "second potential" is a potential set such that toner is more likely to be biased from the supply roller 5 to the developing roller 4 than the "first potential". With this control, it is possible to suppress a phenomenon in which a toner image is formed on the photosensitive drum 1 where no electrostatic latent image is formed (hereinafter referred to as "fogging") when the pre-rotation period and the inter-sheet period are long and to suppress consumption of toner in the developing chamber. In the description of Example 4, description of the portions overlapping those of the above-described examples will not be provided The pre-rotation period and the inter-sheet period may become longer than the normal period depending on an image to be printed and the type of the recording material 12. In this case, when a potential difference is set in such a direction that toner is biased from the developing roller 4 to the supply roller 5, the toner having the normal charging polarity on the developing roller 4 is collected by the supply roller 5, and the proportion of the toner having a polarity opposite to the normal charging polarity or the proportion of the toner of which the charge amount is close to 0 increases. When the proportion of the toner having a polarity opposite to the normal charging polarity or the proportion of the toner of which the charge amount is close to 0 increases excessively, toner might be consumed unnecessarily. In contrast, with the control of the present example, it is possible to suppress unnecessary consumption of toner due to fogging even when the pre-rotation period and the inter-sheet period are long and to diminish development ghost and prevent solid image compliance defects.

Figure 6:
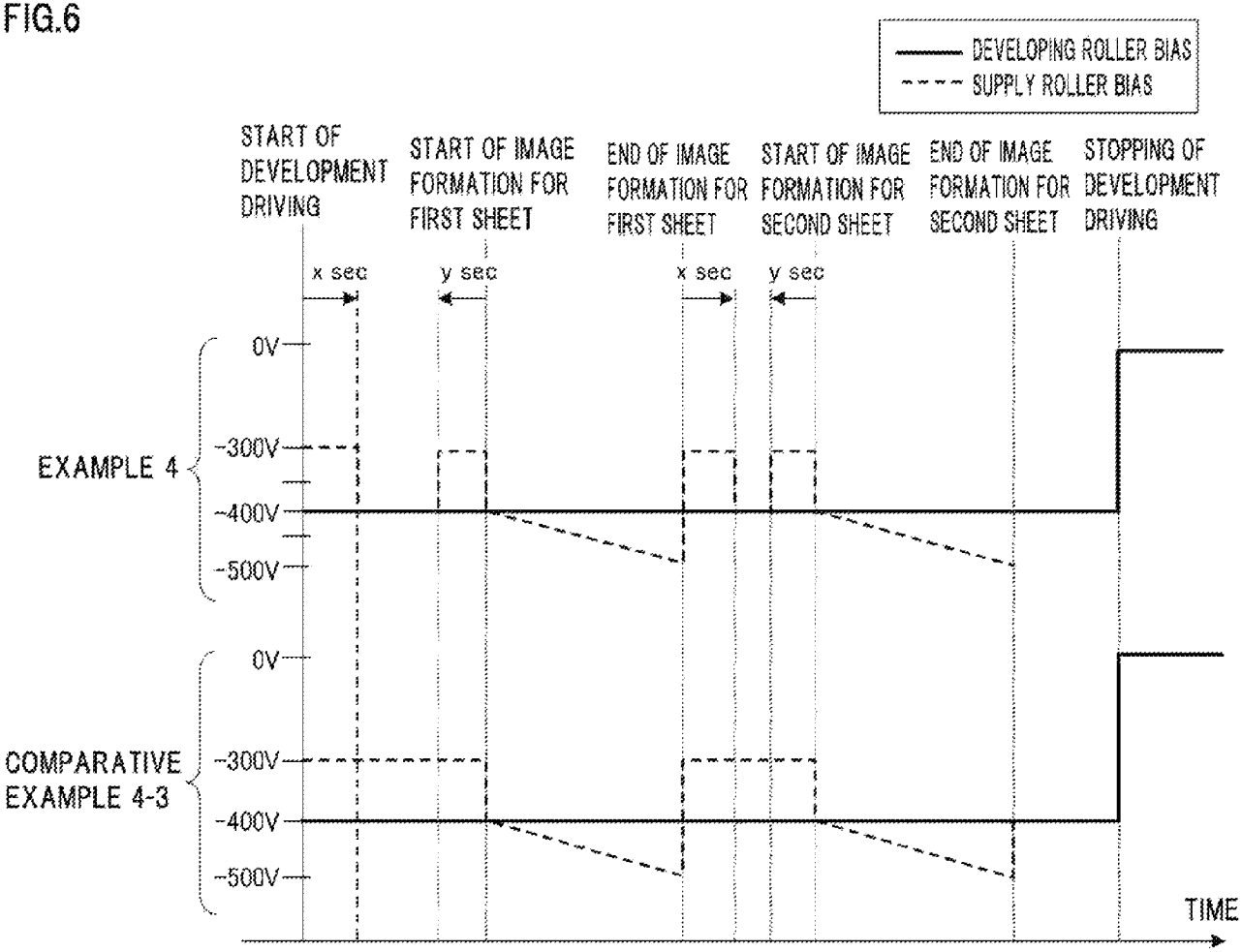
FIG. 6 is a timing chart of voltage control in Example 4 of the present invention.
Figure 7:
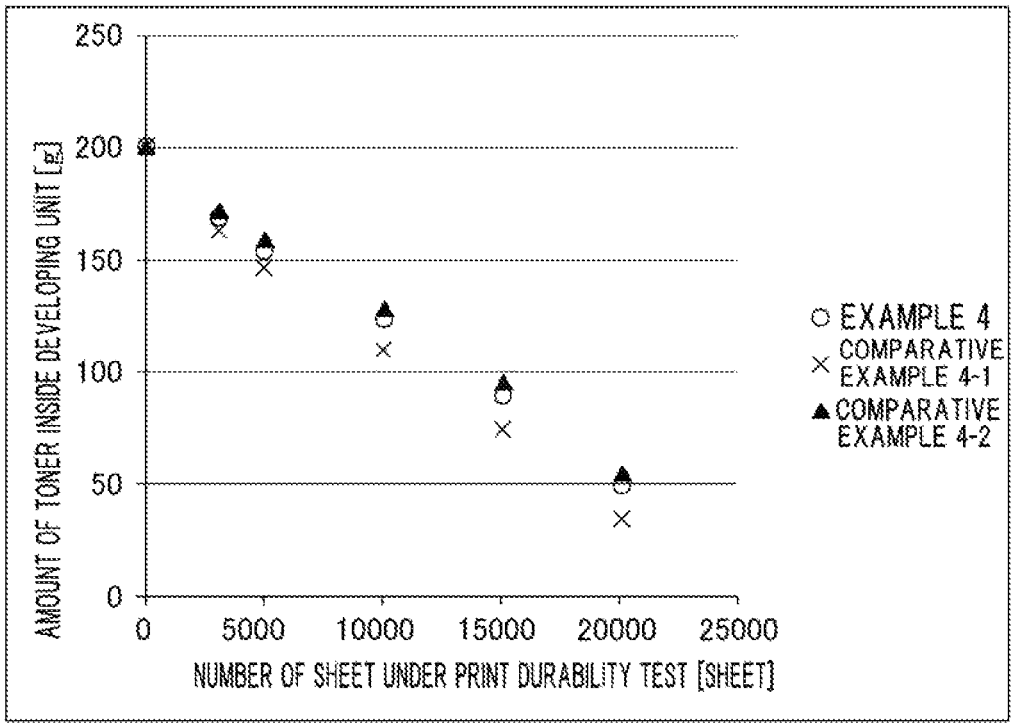
FIG. 7 illustrates experiment results used for illustrating the advantages of Example 4 of the present invention.

The control according to Example 4 will be described with reference to the timing chart of FIG. 6. FIG. 6 is a timing chart illustrating bias control when two sheets are printed continuously, for comparison between Example 4 and Comparative Example 4-3 (Example 1). As illustrated in FIG. 6, in Example 4, first, the application bias is controlled so that the potential difference between the developing roller 4 and the supply roller 5 becomes "first potential" at the time-point "start of development driving". A period x of switching from the "first potential" to the "second potential" is set in advance, and when the time elapsed from the time-point "start of development driving" is x sec or more, the bias applied to the supply roller 5 is controlled so that the potential difference becomes the "second potential". Moreover, a period y of switching from the "second potential" to the "first potential" before the time-point "start of image formation" is set in advance, and the bias applied to the supply roller 5 is controlled so that the potential difference becomes the "first potential" when it is y sec before the time-point "start of image formation". Moreover, in the inter-sheet period, control of switching from the "first potential" to the "second potential" is performed according to the time from the previous "end of image formation," and control of switching from the "second potential" to the "first potential" is performed when it is y sec before the subsequent "start of image formation". With this control, it is possible to prevent an excessive increase in the proportion of the toner having a polarity opposite to the normal charging polarity or the proportion of the toner of which the charge amount is close to 0, which remain on the developing roller 4, and to suppress the occurrence of fogging. A case where such control is not performed is illustrated as Comparative Example 4-3 in FIG. 6.

[Experiment]

As an experiment for illustrating the advantages of the present example, a state where the pre-rotation period and the inter-sheet period were longer than the set periods was created for simulation purposes, and an intermittent print durability test was performed for two sheets under an environment of a room temperature (23° C.) and a room humidity (60%). In this print durability test, horizontal lines having an image ratio of 1% were printed on a recording material. In this print durability test, the amount of toner remaining in the developing unit was measured when 3000, 5000, 10000, 15000, and 20000 sheets were printed, and the amount of consumed toner from before the print durability test was measured. The pre-rotation period and the inter-sheet period were set to 3 sec, and x=0.5 sec and y=0.5 sec. Moreover, a constant bias of −400 V was applied to the developing roller 4, a bias of −300 V was applied to the supply roller 5 at the time-point "first potential," and a bias of −400 V was applied to the supply roller 5 at the time-point "second potential".

In order to compare the advantages of the present example with those of comparative examples, the same experiment was performed when control was performed according to the following two comparative examples.

In Comparative Example 4-1, the pre-rotation period and the inter-sheet period were set to 3 sec and x=4 sec and y=4 sec, and the bias applied to the supply roller 5 was not changed even when the pre-rotation period and the inter-sheet period were long.

In Comparative Example 4-2, the pre-rotation period and the inter-sheet period were short and were set to 0.5 sec, and x=0.5 sec and y=0.5 sec.

Experiment results are illustrated in FIG. 9.

When control was performed according to Comparative Example 4-1, with the progress of the print durability test, the proportion of the toner having a polarity opposite to the normal charging polarity or the proportion of the toner of which the charge amount is close to 0 on the developing roller increased excessively, and fogging occurred in the pre-rotation period and the inter-sheet period. Due to this, toner was consumed unnecessarily, and the reduction in the amount of toner remaining in the developing unit increased with an increase in the number of sheets used for the print durability test.

On the other hand, when control was performed according to the present example, since consumption of toner due to fogging was suppressed in the pre-rotation period and the inter-sheet period, it was possible to accomplish the reduction in the amount of toner equivalent to that when the pre-rotation period and the inter-sheet period were short illustrated in Comparative Example 4-2. That is, with the control of the present example, it was possible to suppress unnecessary consumption of toner in the pre-rotation period and the inter-sheet period.

Example 5

An image forming apparatus according to Example 5 of the present invention performs control of avoiding an abrupt change in the potential difference between the developing roller 4 and the supply roller 5 in the period from the pre-rotation period to the switching at the start of image formation. Specifically, first, a time-point "start of potential difference control" is set to be before the time-point "start of image formation". Moreover, when the potential difference between the developing roller 4 and the supply roller 5 during the pre-rotation period is switched to the potential difference at "start of image formation," the potential difference between the developing roller 4 and the supply roller 5 is changed so as to have an inclination between "start of potential difference control" and "start of image formation". With the control of the present example, when the potential difference between the developing roller 4 and the supply roller 5 at the time-point "start of image formation" changes greatly from the potential difference during the pre-rotation period, it is possible to suppress an overshoot occurring when the bias switches. As a result, it is possible to prevent image voids occurring at the leading edge of an image. In the description of Example 5, description of the portions overlapping those of the above-described examples will not be provided.

Figure 8:
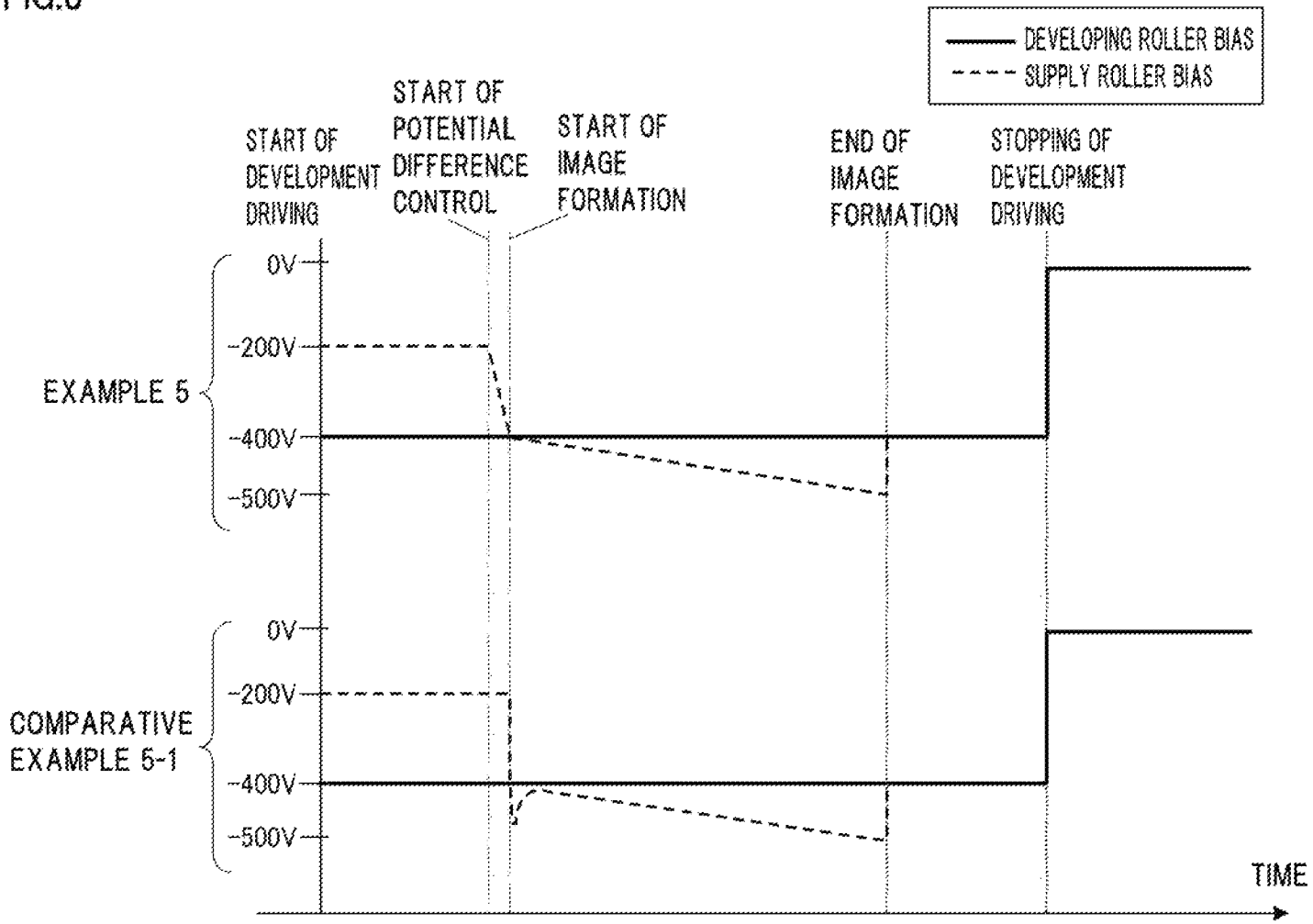
FIG. 8 is a timing chart of voltage control in Example 5 of the present invention.

The control according to Example 5 will be described with reference to the timing chart of FIG. 8. FIG. 8 is a timing chart illustrating the bias control when one sheet is printed, for comparison between Example 5 and Comparative Example 5-1. As illustrated in FIG. 8, in the present example, a bias is applied in such a direction that toner is biased from the developing roller 4 to the supply roller 5 at the time-point "start of development driving," and a constant bias is applied up to the time-point "start of potential difference control". Moreover, the bias applied to the supply roller 5 is changed in the period between the time-point "start of potential difference control" and the time-point "start of image formation" so that a desired bias is applied at the time-point "start of image formation". The control subsequent to the time-point "start of image formation" is the same as the control described in Example 1, and description thereof will not be provided.

When the potential difference between the developing roller 4 and the supply roller 5 during the pre-rotation period is increased such that force that biases toner from the developing roller 4 to the supply roller 5 acts on the toner, the performance of the supply roller 5 collecting toner on the developing roller 4 during the pre-rotation period is improved, and development ghost can be diminished further. However, when the difference between the potential difference between the developing roller 4 and the supply roller 5 during the pre-rotation period and the potential difference between the developing roller 4 and the supply roller 5 at the time-point "start of image formation" is large, the possibility of an overshoot increases. An example where an overshoot occurs is illustrated in FIG. 6 as Comparative Example 5-1. When an overshoot occurs, a phenomenon in which the amount of toner supplied from the supply roller 5 to the developing roller 4 decreases remarkably due to the abrupt change in the potential difference may occur, and image voids may appear on the image immediately after the time-point "start of image formation". On the other hand, when the time-point "start of potential difference control" is provided and the bias applied to the supply roller 5 is changed gradually until the time-point "start of image formation," it is possible to prevent an abrupt change in the amount of supplied toner.

In the control of the present example, a constant bias of −400 V was applied to the developing roller 4 in the period between "start of development driving" and "stopping of development driving". Moreover, a bias of −200 V was applied to the supply roller 5 during the pre-rotation period and a bias of −400 V was applied to the supply roller 5 at the time-point "start of potential difference control". Further, the time-point "start of potential difference control" was set to occur 0.025 sec before the time-point "start of image formation".

[Experiment]

The following experiment was performed in order to verify the advantages of the present example. As an example for comparing with the advantages of the present example, the same experiment was performed for Comparative Example 5-1 in which the time-point "start of potential difference control" was not provided, and the potential difference was switched at once at the time-point "start of image formation". The experiment was performed under an environment of a room temperature (23° C.) and a room humidity (60%), and it was checked whether image voids occurred at the leading edge of a full solid image. Moreover, the image voids were ranked based on a density difference using an X-Rite's 500-Series spectrodensitometer measuring the density at the leading sheet edge and the trailing sheet edge of the full solid image. In this case, the test print and the evaluation image were printed in a single color.

A: Density difference between leading sheet edge and trailing sheet edge in full solid image is less than 0.2

B: Density difference between leading sheet edge and trailing sheet edge in full solid image is 0.2 or more and less than 0.3

C: Density difference between leading sheet edge and trailing sheet edge in full solid image is 0.3 or more The experiment results are illustrated in Table 4.

TABLE 4

| | Image Voids in Leading Edge |
|---|---|
| Example 5-1 | A |
| Comparative Example 5-1 | B |

In Comparative Example 5-1 where the time-point "start of potential difference control" was not provided and the bias applied to the supply roller 5 was changed at once at the time-point "start of image formation," such an overshoot as illustrated in FIG. 8 occurred. Moreover, depending on the potential difference, as illustrated in Table 4, a slight level of image voids at the leading edge appeared. On the other hand, when the control of the present example was performed to gradually change the bias applied to the supply roller 5 at the time-point "start of image formation," it was possible to suppress the occurrence of an overshoot and to prevent the occurrence of image voids at the leading edge.

The respective configurations of the respective examples may be combined with each other. In the examples described above, a configuration in which the normal charging polarity of toner is negative and the respective application biases are negative have been described. However, even when the normal charging polarity of toner is positive and the application biases are positive, by comparing the magnitudes of the absolute value of potentials the present invention can be naturally applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-052722, filed on Mar. 14, 2014, which is hereby incorporated by reference herein in its entirety.

What is claimed is:

1. An image forming apparatus that forms an image on a recording material, comprising:

a developer bearing member that bears a developer and develops an electrostatic latent image formed on an image bearing member;

a developing bias application unit that applies a developing bias to the developer bearing member;

a developer supply member that is provided so as to make contact with the developer bearing member and supplies developer to the developer bearing member; and a supply bias application unit that applies a supply bias to the developer supply member, wherein in a predetermined period before a start of image formation during an image forming operation for an image formed on one recording material, the supply bias application unit applies a supply bias of which the magnitude of an absolute value is smaller than that of a developing bias, to the developer supply member, and in a period between the start of image formation and an end of image formation during the image forming operation for the image formed on one recording material, the supply bias application unit applies a supply bias to the developer supply member so that a difference in the magnitude of the absolute value from the supply bias in the predetermined period before the start of image formation increases gradually.

2. The image forming apparatus according to claim 1, wherein in the period between the start of image formation and the end of image formation during the image forming operation for the image formed on one recording material, the developing bias application unit applies a developing bias to the developer bearing member and the supply bias application unit applies a supply bias to the developer supply member so that a difference between the magnitude of the developing bias and the magnitude of the supply bias increases gradually.

3. The image forming apparatus according to claim 1, wherein in the period between the start of image formation and the end of image formation during the image forming operation for the image formed on one recording material, the developing bias application unit applies a developing bias having a constant magnitude to the developer bearing member, and the supply bias application unit applies a supply bias of which the magnitude of an absolute value increases gradually, to the developer supply member.

4. The image forming apparatus according to claim 1, wherein in the period between the start of image formation and the end of image formation during the image forming operation for the image formed on one recording material, a polarity of a change per unit time of a supply bias applied by the supply bias application unit is the same as a charging polarity of the developer.

5. The image forming apparatus according to claim 1, wherein in the period between the start of image formation and the end of image formation during the image forming operation for the image formed on one recording material, a change per unit time of a supply bias applied by the supply bias application unit is constant.

6. The image forming apparatus according to claim 1, wherein in the period between the start of image formation and the end of image formation during the image forming operation for the image formed on one recording material, a change per unit time of a supply bias applied by the supply bias application unit changes at least once.

7. The image forming apparatus according to claim 1, wherein in the period between the start of image formation and the end of image formation during the image forming operation for the image formed on one recording material, a change per unit time of a supply bias applied by the supply bias application unit changes gradually.

8. The image forming apparatus according to claim 1, wherein when images are formed continuously on a plurality of recording materials, the supply bias application unit applies a supply bias, of which the magnitude of an absolute value is smaller than the magnitude of an absolute value of a supply bias applied at a start of image formation during an image forming operation for an image formed on a first recording material, at a start of image formation during an image forming operation for an image formed on a second recording material subsequent to the first recording material.

9. The image forming apparatus according to claim 1, wherein in a period excluding the period between the start of image formation and the end of image formation during the image forming operation for the image formed on one recording material, the supply bias application unit has a period in which a supply bias having a magnitude such that a polarity of the magnitude of the supply bias in relation to a developing bias is opposite to a normal charging polarity of the developer is applied.

10. The image forming apparatus according to claim 1, wherein in a period excluding the period between the start of image formation and the end of image formation during the image forming operation for the image formed on one recording material, the supply bias application unit has:

a first period in which a supply bias having a first magnitude such that a polarity of the magnitude of the supply bias in relation to a developing bias is opposite to a normal charging polarity of the developer is applied; and a second period in which a supply bias having a second magnitude different from the first magnitude is applied.

11. The image forming apparatus according to claim 1, wherein when images are formed continuously on a plurality of recording materials, in a period between an end of image formation during an image forming operation for an image formed on a first recording material and a start of image formation during an image forming operation for an image formed on a second recording material subsequent to the first recording material, the supply bias application unit has a period in which a supply bias having a magnitude such that a polarity of the magnitude of the supply bias in relation to a developing bias is opposite to a normal charging polarity of the developer is applied.

12. The image forming apparatus according to claim 1, wherein when images are formed continuously on a plurality of recording materials, in a period between an end of image formation during an image forming operation for an image formed on a first recording material and a start of image formation during an image forming operation for an image formed on a second recording material subsequent to the first recording material, the supply bias application unit has:

a first period in which a supply bias having a first magnitude such that a polarity of the magnitude of the supply bias in relation to a developing bias is opposite to a normal charging polarity of the developer is applied; and a second period in which a supply bias having a second magnitude different from the first magnitude is applied.

13. The image forming apparatus according to claim 1, wherein in a predetermined period before a start of image formation during an image forming operation for an image formed on one recording material, the supply bias application unit has:

a third period in which a supply bias having a third magnitude such that a polarity of the magnitude of the supply bias in relation to a developing bias is opposite to a normal charging polarity of the developer is applied; and a fourth period which occurs between the third period and the start of image formation and in which a supply bias of which the magnitude changes gradually from the third magnitude to a magnitude at the start of image formation is applied.

14. An image forming apparatus that forms an image on a recording material, comprising:

a developer bearing member that bears a developer and develops an electrostatic latent image formed on an image bearing member;

a developing bias application unit that applies a developing bias to the developer bearing member;

a developer supply member that is provided so as to make contact with the developer bearing member and supplies developer to the developer bearing member; and a supply bias application unit that applies a supply bias to the developer supply member, wherein in a predetermined period before a start of image formation during an image forming operation for an image formed on one recording material, the supply bias application unit applies a supply bias of which the magnitude of an absolute value is smaller than that of a developing bias, to the developer supply member, and in a period between the start of image formation and an end of image formation during the image forming operation for the image formed on one recording material, the developing bias application unit applies a developing bias to the developer bearing member and the supply bias application unit applies a supply bias to the developer supply member so that a biasing force that biases developer in a contact region between the developer bearing member and the developer supply member from the developer supply member to the developer bearing member gradually increases.

15. An image forming apparatus that forms an image on a recording material, comprising:

a developer bearing member that develops an electrostatic latent image formed on an image bearing member; and a developer supply member that supplies developer to the developer bearing member, wherein in a predetermined period before a start of image formation during an image forming operation for an image formed on one recording material, a supply bias of which the magnitude of an absolute value is smaller than that of a developing bias applied to the developer bearing member is applied to the developer supply member, and in a period between the start of image formation and an end of image formation during the image forming operation for the image formed on one recording material, a supply bias is applied to the developer supply member so that a difference in the magnitude of the absolute value from the supply bias in the predetermined period before the start of image formation increases gradually.

16. A process cartridge comprising:

a developer bearing member that develops an electrostatic latent image formed on an image bearing member; and a developer supply member that supplies developer to the developer bearing member, wherein in a predetermined period before a start of image formation during an image forming operation for an image formed on one recording material, a supply bias of which the magnitude of an absolute value is smaller than that of a developing bias applied to the developer bearing member is applied to the developer supply member, and in a period between the start of image formation and an end of image formation during the image forming operation for the image formed on one recording material, a supply bias is applied to the developer supply member so that a difference in the magnitude of the absolute value from the supply bias in the predetermined period before the start of image formation increases gradually.

* * * * *